US012654902B2

(12) United States Patent
Smith

(10) Patent No.: US 12,654,902 B2
(45) Date of Patent: Jun. 16, 2026

(54) CARTON WITH DISPENSER

(71) Applicant: Graphic Packaging International, LLC, Atlanta, GA (US)

(72) Inventor: Jeffrey D. Smith, Solon, OH (US)

(73) Assignee: Graphic Packaging International, LLC, Atlanta, GA (US)

( * ) Notice: Subject to any disclaimer, the term of this patent is extended or adjusted under 35 U.S.C. 154(b) by 60 days.

(21) Appl. No.: 18/440,140

(22) Filed: Feb. 13, 2024

(65) Prior Publication Data

US 2024/0270439 A1 Aug. 15, 2024

Related U.S. Application Data

(60) Provisional application No. 63/445,384, filed on Feb. 14, 2023.

(51) Int. Cl.
*B65D 5/74* (2006.01)
*B65D 5/66* (2006.01)
*B65D 5/70* (2006.01)

(52) U.S. Cl.
CPC ..... *B65D 5/745* (2013.01); *B65D 5/6602* (2013.01); *B65D 5/701* (2013.01)

(58) Field of Classification Search
CPC ..... B65D 5/745; B65D 5/6602; B65D 5/701; B65D 5/541; B65D 85/60; B65D 5/4208; B65D 5/723; B65D 5/029; B65D 5/0227; B65D 5/721; B65D 5/062; B65D 5/705; B65D 5/72
USPC ..... 229/215, 122, 129.1, 126, 220
See application file for complete search history.

(56) References Cited

U.S. PATENT DOCUMENTS

| | | | |
|---|---|---|---|
| 1,951,274 | A | 3/1934 | Denman |
| 2,069,281 | A | 2/1937 | Sebreny |
| 2,335,363 | A | 11/1943 | Shelton |
| 2,610,770 | A | 9/1952 | Penfield |

(Continued)

FOREIGN PATENT DOCUMENTS

| | | |
|---|---|---|
| CH | 412695 | 4/1966 |
| CH | 681293 | 2/1993 |

(Continued)

OTHER PUBLICATIONS

International Search Report and Written Opinion for PCT/US2024/015528 dated Jun. 11, 2024.

*Primary Examiner* — Christopher R Demeree
(74) *Attorney, Agent, or Firm* — Andrew N. Claerbout; FisherBroyles, LLP

(57) ABSTRACT

A carton for at least one article includes a plurality of panels, a panel of the plurality of panels least partially defining a first dispenser opening, at least one top end flap having a base portion and a distal portion, the distal portion of the at least one top end flap at least partially defining a second dispenser opening, and a reconfigurable dispenser including the at least one top end flap, the first dispenser opening, and the second dispenser opening, the reconfigurable dispenser being reconfigurable between a first configuration providing a closed end of the carton, and a second configuration, in which the reconfigurable dispenser is lifted away from the interior of the carton such that the first dispenser opening and second dispenser opening are at least partially aligned to provide access to the interior of the carton.

42 Claims, 5 Drawing Sheets

(56) References Cited

U.S. PATENT DOCUMENTS

| | | | |
|---|---|---|---|
| 2,898,004 | A | 8/1959 | Klausmann et al. |
| 2,943,769 | A | 7/1960 | Klausmann |
| 2,975,952 | A | 3/1961 | Tamarin |
| 2,980,540 | A | 4/1961 | Turpin |
| 2,983,424 | A | 5/1961 | Glass |
| 3,033,436 | A | 5/1962 | Peimer |
| 3,040,953 | A | 6/1962 | Tindall |
| 3,057,524 | A | 10/1962 | Shanks |
| 3,114,474 | A | 12/1963 | Davis |
| 3,166,229 | A | 1/1965 | Sherman et al. |
| 3,187,961 | A | 6/1965 | Moore |
| 3,235,144 | A | 2/1966 | Pitkin et al. |
| 3,298,576 | A | 1/1967 | Sellors |
| 3,302,847 | A | 2/1967 | Hennessey |
| 3,347,446 | A | 10/1967 | Guyer et al. |
| 3,441,002 | A | 4/1969 | Lawalin et al. |
| 3,563,449 | A | 2/1971 | Forbes, Jr. |
| 3,804,321 | A | 4/1974 | Forbes, Jr. |
| 3,831,833 | A | 8/1974 | Dressler et al. |
| 3,894,680 | A | 7/1975 | Araki |
| 3,921,862 | A | 11/1975 | Holmstrom |
| 4,081,128 | A | 3/1978 | O'Neill |
| 4,094,456 | A | 6/1978 | Raccaforte |
| 4,111,351 | A | 9/1978 | Mackiernan |
| 4,113,086 | A | 9/1978 | Forbes, Jr. |
| 4,138,016 | A | 2/1979 | Roccaforte |
| 4,141,485 | A | 2/1979 | Lambert |
| 4,197,985 | A | 4/1980 | Austin |
| 4,201,329 | A | 5/1980 | Roccaforte |
| 4,261,483 | A | 4/1981 | Dutcher |
| 4,279,373 | A | 7/1981 | Montealgre |
| 4,342,417 | A | 8/1982 | Forbes, Jr. |
| 4,361,270 | A | 11/1982 | Roccaforte |
| 4,609,142 | A | 9/1986 | Adamek |
| 5,056,708 | A | 10/1991 | Boyle et al. |
| 5,429,297 | A | 7/1995 | Walsh |
| 5,465,834 | A | 11/1995 | Sieber et al. |
| 5,503,268 | A | 4/1996 | Pham |
| 5,505,373 | A | 4/1996 | Von Stillfried |
| 5,810,250 | A | 9/1998 | Stone et al. |
| 5,875,962 | A | 3/1999 | Jorgensen-Beck et al. |
| 6,047,829 | A | 4/2000 | Johnstone |
| 6,213,388 | B1 | 4/2001 | Ours et al. |
| 6,230,893 | B1 | 5/2001 | Karow |
| 6,318,593 | B1 | 11/2001 | Laughlin et al. |
| 6,412,636 | B1 | 7/2002 | Jones |
| 6,752,272 | B2 | 6/2004 | Jones |
| 6,945,449 | B2 | 9/2005 | Hengami |
| 7,156,286 | B2 | 1/2007 | Hengami |
| 7,503,475 | B2 | 3/2009 | McGowan |
| 7,712,653 | B2 | 5/2010 | DeBusk et al. |
| 7,743,973 | B2 * | 6/2010 | Hegami ..... B65D 5/723 229/122 |
| 8,220,702 | B2 | 7/2012 | DeBusk et al. |
| 8,800,855 | B2 | 8/2014 | Fitzwater |
| 9,085,386 | B2 * | 7/2015 | Hengami ..... B65D 5/0227 |
| 9,156,579 | B2 | 10/2015 | Pinkstone |
| 9,394,066 | B2 * | 7/2016 | Hengami ..... B65B 43/08 |
| 9,394,076 | B2 * | 7/2016 | Hengami ..... B65D 5/0227 |
| 9,598,202 | B2 | 3/2017 | Oliveira et al. |
| 10,086,990 | B2 * | 10/2018 | Hengami ..... B65D 85/60 |
| 10,232,976 | B2 | 3/2019 | Waddington |
| 11,142,365 | B2 | 10/2021 | Kearns et al. |
| 11,732,216 | B2 | 8/2023 | Sivik et al. |
| 11,794,947 | B2 | 10/2023 | Hoefte et al. |
| 11,905,080 | B2 | 2/2024 | Gungner |
| 11,932,468 | B2 | 3/2024 | Hoefte et al. |
| 11,965,147 | B2 | 4/2024 | Sivik et al. |
| 12,006,489 | B2 | 6/2024 | Huang et al. |
| 12,084,242 | B2 | 9/2024 | Pinkstone et al. |
| 12,116,186 | B2 | 10/2024 | Pinkstone et al. |
| 12,325,564 | B2 * | 6/2025 | Hengami ..... B65D 5/0254 |
| 12,351,372 | B2 * | 7/2025 | Spitler ..... B65D 5/721 |
| 2004/0065723 | A1 | 4/2004 | Hengami |
| 2008/0296359 | A1 | 12/2008 | Kortsmit et al. |
| 2010/0270367 | A1 | 10/2010 | Brandenburger |
| 2011/0168767 | A1 | 7/2011 | Hengami |
| 2013/0313311 | A1 | 11/2013 | Fath et al. |
| 2015/0083789 | A1 | 3/2015 | Fitzwater et al. |
| 2018/0170610 | A1 | 6/2018 | Buss |
| 2022/0227565 | A1 | 7/2022 | Ashcroft |
| 2023/0249873 | A1 | 8/2023 | Spitler |
| 2023/0286695 | A1 | 9/2023 | Hoefte et al. |
| 2023/0312166 | A1 | 10/2023 | Waddington |
| 2023/0322435 | A1 | 10/2023 | Brink |
| 2023/0339670 | A1 | 10/2023 | Brink et al. |
| 2024/0270439 | A1 | 8/2024 | Smith |
| 2024/0270446 | A1 | 8/2024 | Oliveira |
| 2024/0391670 | A1 | 11/2024 | Mills et al. |

FOREIGN PATENT DOCUMENTS

| | | | |
|---|---|---|---|
| EP | 1968858 | B1 | 6/2011 |
| GB | 385033 | | 12/1932 |
| JP | 09-002463 | A | 1/1997 |
| JP | 10-310131 | A | 11/1998 |
| JP | 2011-173640 | A | 9/2011 |
| JP | 2011-189978 | A | 9/2011 |
| NL | 100017 | | 12/1961 |
| WO | WO 2012/061175 | | 5/2012 |
| WO | WO 2012/061682 | | 5/2012 |

* cited by examiner

CARTON WITH DISPENSER

CROSS-REFERENCE TO RELATED APPLICATION

The present application claims the benefit of U.S. Provisional Patent Application No. 63/445,384, filed on Feb. 14, 2023.

INCORPORATION BY REFERENCE

The disclosure of U.S. Provisional Patent Application No. 63/445,384, filed on Feb. 14, 2023, is hereby incorporated by reference for all purposes as if set forth in its entirety.

BACKGROUND

The present disclosure generally relates to cartons for holding and dispensing articles.

SUMMARY

According to one aspect, the disclosure is generally directed to a carton for holding at least one article, the carton comprising a plurality of panels extending at least partially around an interior of the carton, the plurality of panels comprising a front panel, a back panel, and at least one side panel, a panel of the plurality of panels least partially defining a first dispenser opening, a plurality of end flaps foldably connected to a respective panel of the plurality of panels, the plurality of end flaps comprising at least one top end flap comprising a base portion and a distal portion, the distal portion of the at least one top end flap at least partially defining a second dispenser opening, and a reconfigurable dispenser, the reconfigurable dispenser comprising the at least one top end flap, the first dispenser opening, and the second dispenser opening, the reconfigurable dispenser being reconfigurable between a first configuration, in which the reconfigurable dispenser at least partially overlies the interior of the carton to provide a closed end of the carton, and a second configuration, in which the reconfigurable dispenser is lifted away from the interior of the carton such that the first dispenser opening and second dispenser opening are at least partially aligned to provide access to the interior of the carton.

According to another aspect, the disclosure is generally directed to a blank for forming a carton for holding at least one article, the blank comprising a plurality of panels for extending at least partially around an interior of the carton formed from the blank, the plurality of panels comprising a front panel, a back panel, and at least one side panel, a panel of the plurality of panels least partially defining a first dispenser opening, a plurality of end flaps foldably connected to a respective panel of the plurality of panels, the plurality of end flaps comprising at least one top end flap comprising a base portion and a distal portion, the distal portion of the at least one top end flap at least partially defining a second dispenser opening, and features for forming a reconfigurable dispenser comprising the at least one top end flap, the first dispenser opening, and the second dispenser opening, the features for forming the reconfigurable dispenser when the carton is formed from the blank such that the reconfigurable dispenser is reconfigurable between a first configuration, in which the reconfigurable dispenser at least partially overlies the interior of the carton formed from the blank to provide a closed end of the carton formed from the blank, and a second configuration, in which the reconfigurable dispenser is lifted away from the interior of the carton formed from the blank such that the first dispenser opening and second dispenser opening are at least partially aligned to provide access to the interior of the carton formed from the blank.

According to another aspect, the disclosure is generally directed to a method of forming a carton for holding at least one article, the method comprising obtaining a plurality of panels comprising a front panel, a back panel, and at least one side panel, a panel of the plurality of panels least partially defining a first dispenser opening, a plurality of end flaps foldably connected to a respective panel of the plurality of panels, the plurality of end flaps comprising at least one top end flap comprising a base portion and a distal portion, the distal portion of the at least one top end flap at least partially defining a second dispenser opening, positioning the plurality of panels extending at least partially around an interior of the carton, and arranging the at least one top end flap, the first dispenser opening, and the second dispenser opening to form a reconfigurable dispenser such that the reconfigurable dispenser is reconfigurable between a first configuration, in which the reconfigurable dispenser at least partially overlies the interior of the carton to provide a closed end of the carton, and a second configuration, in which the reconfigurable dispenser is lifted away from the interior of the carton such that the first dispenser opening and second dispenser opening are at least partially aligned to provide access to the interior of the carton.

Those skilled in the art will appreciate the above-stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION

Cartons according to the present disclosure can accommodate articles of numerous different shapes. For the purpose of illustration and not for the purpose of limiting the scope of the disclosure, the following detailed description describes articles such as food products. Such food products can be provided in discrete or granular portions, e.g., as in snacks, for example, candy, gum, mints, chocolate, granola, cereal, nuts, trail mix, raisins, dried fruit, etc. It will be understood that a different type of article such as a different type of food product can be held in cartons according to the present disclosure without departing from the disclosure. It will be further understood that articles other than food products can be held in cartons according to the present disclosure.

In this specification, the terms "lower," "bottom," "upper," and "top" indicate orientations determined in relation to fully erected and upright cartons. As described herein, cartons can be formed from blanks by overlapping multiple panels, portions, and/or end flaps. Such panels, portions and/or end flaps may be designated herein in terms relative to one another, e.g., "first", "second", "third", etc., in sequential or non-sequential reference, without departing from the disclosure.

Figure 1:
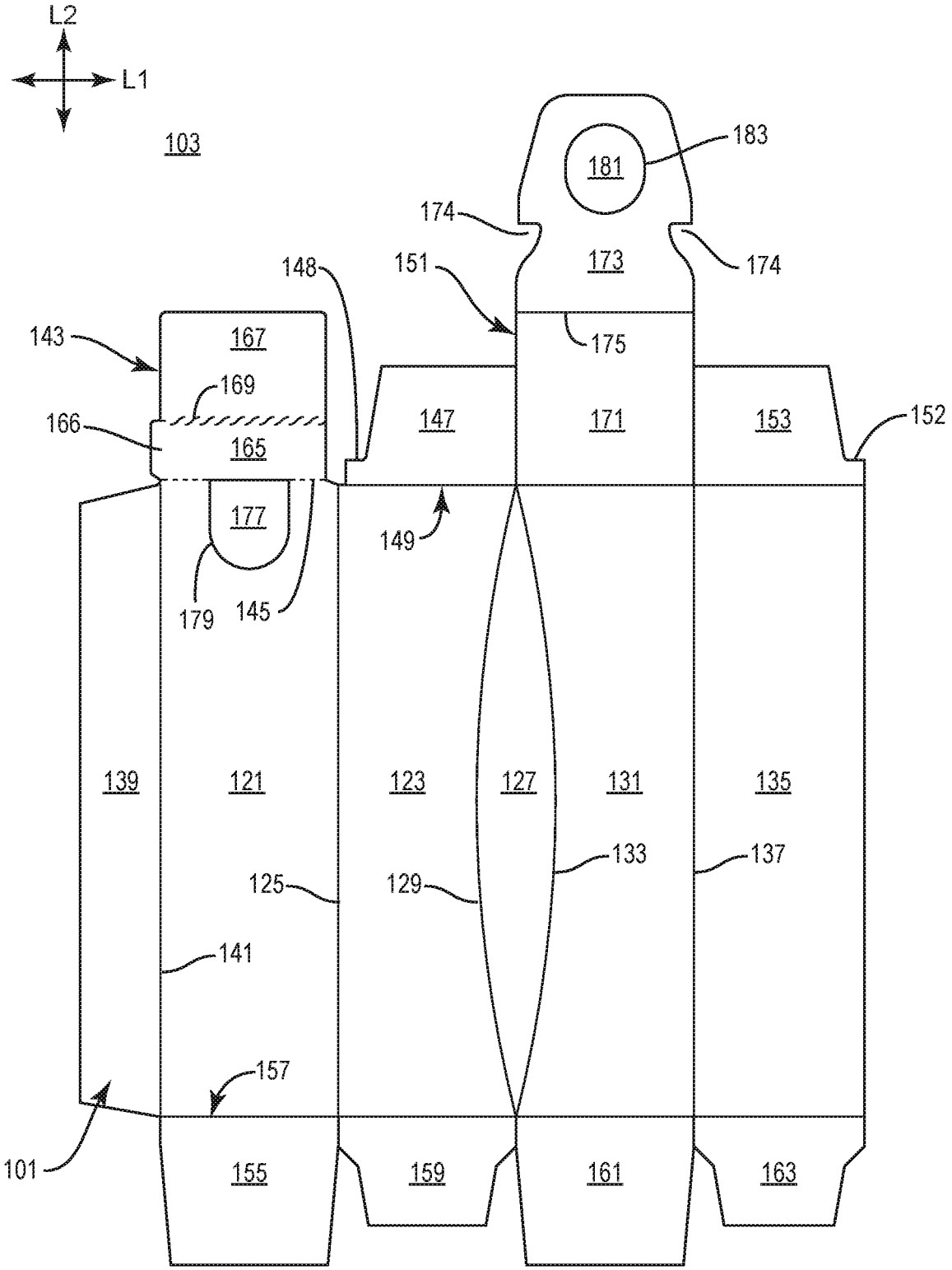
FIG. 1 is a plan view of an exterior surface of a blank used to form a carton according to an exemplary embodiment of the disclosure.

FIG. 1 is a plan view of an exterior surface 101 of a blank, generally indicated at 103, used to form a container or carton 105 (FIG. 2) according to an exemplary embodiment of the disclosure. As described further herein, the carton 105 can be provided with dispenser features forming a reconfigurable dispenser 109 facilitating the metered or selective release of one or more articles A from an interior 107 of the carton 105. As also described further herein, the carton 105 can be provided with access features for reconfiguring an end of the carton 105 between a closed configuration and an at least partially open configuration. In some embodiments, the access features can provide selective access to an end of the carton 105 associated with the dispenser 109 such that the access features can facilitate reconfiguration of the dispenser 109 between a first configuration and a second configuration.

As shown in FIG. 1, the blank 103 can have a longitudinal axis L1 and a lateral axis L2, and a plurality of panels for extending at least partially around the interior 107 of the carton 105 formed from the blank 103.

In the illustrated embodiment, the plurality of panels of the blank 103 and carton 105 formed therefrom can include a first side panel 121 (broadly, "back panel"), a second side panel 123 (broadly, "first side panel") foldably connected to the first side panel 121 at a lateral fold line 125, a corner panel 127 (broadly, "fifth side panel") foldably connected to the second side panel 123 at a curved fold line 129, a third side panel 131 (broadly, "front panel") foldably connected to the corner panel 127 at a curved fold line 133, and a fourth side panel 135 (broadly, "second side panel") foldably connected to the third side panel 131 at a lateral fold line 137. An attachment flap or attachment panel 139 can also be foldably connected to the first side panel 121 at a lateral fold line 141.

While the corner panel 127 is illustrated as being at least partially defined between the pair of curved fold lines 129, 133, with the curved fold lines 129, 133 curved generally outwardly in opposing directions, it will be understood that the corner panel 127 and/or curved fold lines 129, 133 can have a different configuration without departing from the disclosure.

The blank 103 and carton 105 formed therefrom can also include a plurality of end flaps foldably connected to a respective panel of the plurality of panels for forming at least one closed end of the carton 105.

In the illustrated embodiment, the plurality of end flaps can include a first top end flap 143 (broadly, "second top end flap") separably and/or foldably connected to the first side panel 121 at a longitudinal tear line 145 (broadly, "first line of weakening"), a second top end flap 147 (broadly, "third top end flap") foldably connected to the second side panel 123 at a respective portion of a longitudinal fold line 149, a third top end flap 151 (broadly, "first top end flap") foldably connected to the third side panel 131 at a respective portion of the fold line 149, and a fourth top end flap 153 foldably connected to the fourth side panel 135 at a respective portion of the fold line 149.

The plurality of end flaps can also include a first bottom end flap 155 foldably connected to the first side panel 121 at a respective portion of a longitudinal fold line 157, a second bottom end flap 159 foldably connected to the second side panel 123 at a respective portion of the fold line 157, a third bottom end flap 161 foldably connected to the third side panel 131 at a respective portion of the fold line 157, and a fourth bottom end flap 163 foldably connected to the fourth side panel 135 at a respective portion of the fold line 157.

The first top end flap 143, as shown, can include a base portion 165 separably connected to the first side panel 121 at the tear line 145, and a distal portion 167 separably connected to the base portion 165 at a generally longitudinal line of weakening 169 (broadly, "second line of weakening"), e.g., a perforation, tear line, etc. As shown, the base portion 165 of the first top end flap 143 can include and/or at least define an access tab 166 extending longitudinally away from the distal portion 167 of the first top end flap 143. In this regard, the base portion 165 can be a tear strip at least partially defined between the lines 145, 169.

Furthermore, the third top end flap 151 can include a base portion 171 foldably connected to the third side panel 131 at the respective portion of the fold line 149, and a distal portion 173 foldably connected to the base portion 171 at a longitudinal fold line 175. The distal portion 173 of the third top end flap 151 can also include and/or at least partially define a pair of recessed notches 174 along opposed free edges thereof.

As shown, the second top end flap 147 and the fourth top end flap 153 can each include and/or at least partially define a respective flanged portion 148, 152 extending away from a respective remainder thereof.

In this regard, the top end flaps 143, 147, 151, 153 generally extend along a marginal portion of the blank 103 formed by the fold lines 145, 149, and the bottom end flaps 155, 159, 161, 163 generally extend along a marginal portion of the blank 103 formed by the fold line 157.

As described herein, the top end flaps 143, 147, 151, 153 are for being at least partially overlapped and/or otherwise arranged to form a top end 111 of the carton 105, and the bottom end flaps 155, 159, 161, 163 are for being at least partially overlapped and/or otherwise arranged to form a bottom end 113 of the carton 105.

It will be understood that, in some embodiments, the attachment flap 139 can be an end flap of the plurality of end flaps.

With continued reference to FIG. 1, the blank 103 and carton 105 formed therefrom can include and/or at least partially define a first dispenser opening 177 formed in the first side panel 121 by a generally U-shaped cut 179 that intersects and interrupts the tear line 145. The distal portion 173 of the top end flap 151 can include and/or at least partially define a second dispenser opening 181 at least partially formed by a generally circular cut 183 in the distal portion 173 of the top end flap 151.

In this regard, at least the first dispenser opening 177 and second dispenser opening 181 and associated features can be dispenser features for forming the dispenser 109 of the carton 105. In some embodiments, one or more portions of one or more of the first side panel 121 and the top end flaps 143, 147, 151, 153 can be dispenser features for forming the dispenser 109.

Furthermore, and as described further herein, the base portion 165 of the first top end flap 143 and associated features can be an access feature of the blank 103 and carton 105 formed therefrom.

Further still, and as described further herein, the flanged portions 148, 152 of the respective top end flaps 147, 151 and the recessed notches 174 of the distal portion 173 of the third top end flap 151 can be stopping features of the blank 103 and carton 105 formed therefrom.

With additional reference to FIG. 2, formation of the carton 105 from the blank 103 according to an exemplary embodiment of the disclosure will be described. In one exemplary embodiment, the blank 103 can be inverted, e.g., such that the exterior surface 101 is positioned on a supporting surface and such that an interior surface opposite the exterior surface 101 is positioned facing upwardly.

The first side panel 121 can be folded at the fold line 125 into at least partial face-to-face contact with respective portions of the side panel 123 and the corner panel 127, and such that the attachment flap 139 is carried into at least partial face-to-face contact with respective portions of the corner panel 127 and the third side panel 131. The fourth side panel 135 can then be folded at the fold line 137 into at least partial face-to-face contact with the side panel 131 and the attachment flap 139.

The panels 121, 123, 127, 131, 135 can then be folded at the respective fold lines 125, 129, 133, and 137 to as to be positioned extending at least partially around the interior 107 of the carton 105, with the panels 121, 131 positioned in spaced and parallel relation, with the panels 123 and 135 each extending from the panel 121 to the panel 131 so as to be in generally perpendicular relation thereto, and with the corner panel 127 extending obliquely between the panel 123 and the panel 121. The attachment flap 139 can also be folded at the fold line 141 such that the exterior surface of the attachment flap 139 can be positioned in at least partial face-to-face contact with the interior surface of the fourth side panel 135.

In such an arrangement, the corner panel 127 can interrupt the generally rectangular profile of the carton 105 so as to provide a visually attractive surface along which graphics or indicia can be provided, e.g., advertising or promotional material, coupons or vouchers, etc. Furthermore, the oblique arrangement of the corner panel 127 can provide a convenient and ergonomic surface to facilitate grasping of the carton 105 by a user, to provide a locating feature along which the user can orient the carton 105 in his or her hands, etc.

The bottom end flaps 155, 159, 161, 163 can then be folded at respective portions of the fold line 157 into at least partial overlapping relation so as to form the bottom end 113 of the carton 105 in a closed configuration. In such an arrangement, one or more articles A can be inserted into the interior 107 of the carton 105.

The top end flaps 147, 153 can then be folded at respective portions of the fold line 149 into generally perpendicular relation with the panels 121, 123, 131, 135 and at least partially overlying the interior 107 of the carton 105. In such an arrangement, in some embodiments, the top end flaps 147, 153 can be positioned in at least partial face-to-face contact with one another.

The top end flap 151 can then be folded at the respective portion of the fold line 149 such that the base portion 171 of the top end flap 151 can be positioned in at least partial face-to-face contact with the top end flaps 147, 153 and such that the distal portion 173 of the top end flap 151 can be positioned extending downwardly into the interior 107 of the carton 105.

In this regard, the distal portion 173 of the top end flap 151 can be folded at the fold line 175 into generally perpendicular relation to the base portion 171 of the top end flap 151, and such that the base portion 171 of the top end flap 151 extends past free edges of the top end flaps 147, 153 and downwardly into the interior 107 of the carton 105. In some embodiments, the distal portion 173 of the top end flap 151 can be positioned in at least partial face-to-face contact with the side panel 121 and configured for slidable movement relative thereto. The top end flap 143 can then be folded at the line 145 into at least partial face-to-face contact with the base portion 171 of the top end flap 151.

It will be understood that, in some embodiments, the top end flaps 143, 147, 151, 153 can be at least partially overlapped as described above and the carton 105 can be inverted so as to load one or more articles A into the interior 107 of the carton 105 prior to overlapping of the bottom end flaps 155, 159, 161, 163.

Figure 2:
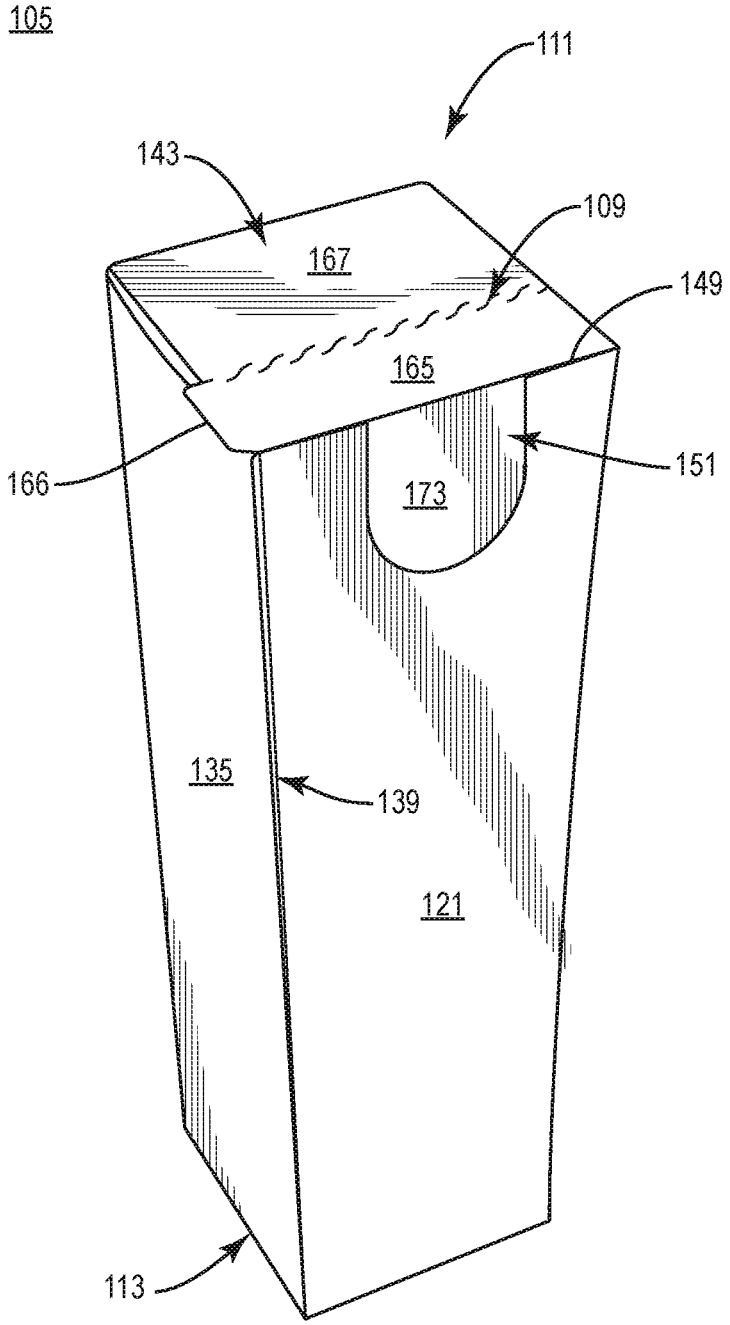
FIG. 2 is a perspective view of a carton formed from the blank of FIG. 1 in a closed configuration according to an exemplary embodiment of the disclosure.

An initial or first or closed configuration of the carton 105 is illustrated in FIG. 2, in which the dispenser 109 is positioned generally overlapping the interior 107 of the carton 105 and restricting access thereto, such that the dispenser 109 is configured as a lid to provide a closed configuration of the top end 111 of the carton 105.

Such an arrangement of the carton 105 can be at least partially maintained with one or more applications of an adhesive such as glue. In some embodiments, such arrangement can be at least partially maintained with one or more applications of an adhesive such as glue. For example, in some embodiments, one or more applications of glue can be applied to exterior surfaces of one or more of the attachment flap 139, the bottom end flap 155, the bottom end flap 159, the bottom end flap 161, the bottom end flap 163, the distal portion 171 of the top end flap 151, and an interior surface of the top end flap 143.

Figure 3:
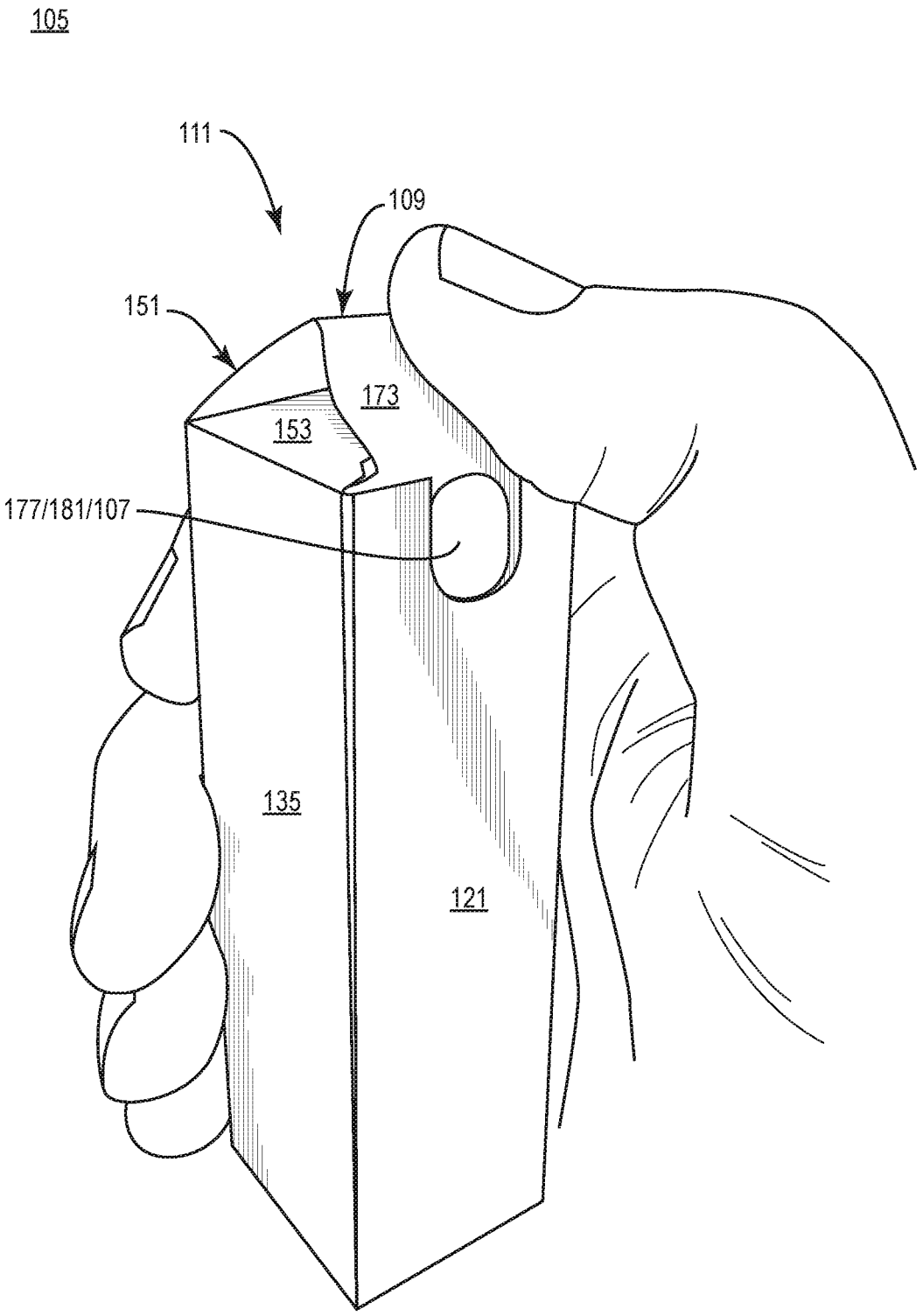
FIG. 3 is a perspective view showing an opening operation of the carton of FIG. 1 according to an exemplary embodiment of the disclosure.
Figure 4:
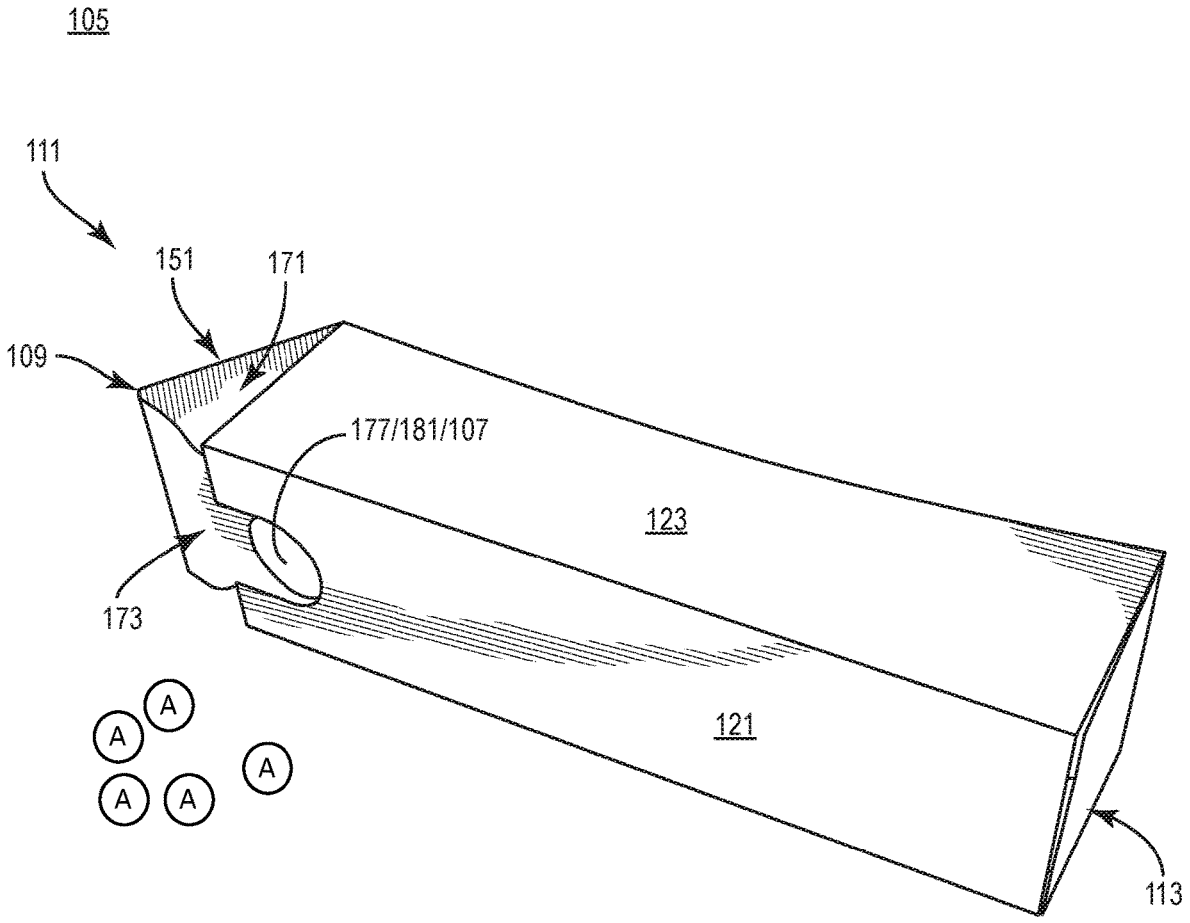
FIG. 4 is a perspective view showing a dispensing operation of the carton of FIG. 1 according to an exemplary embodiment of the disclosure.
Figure 5:
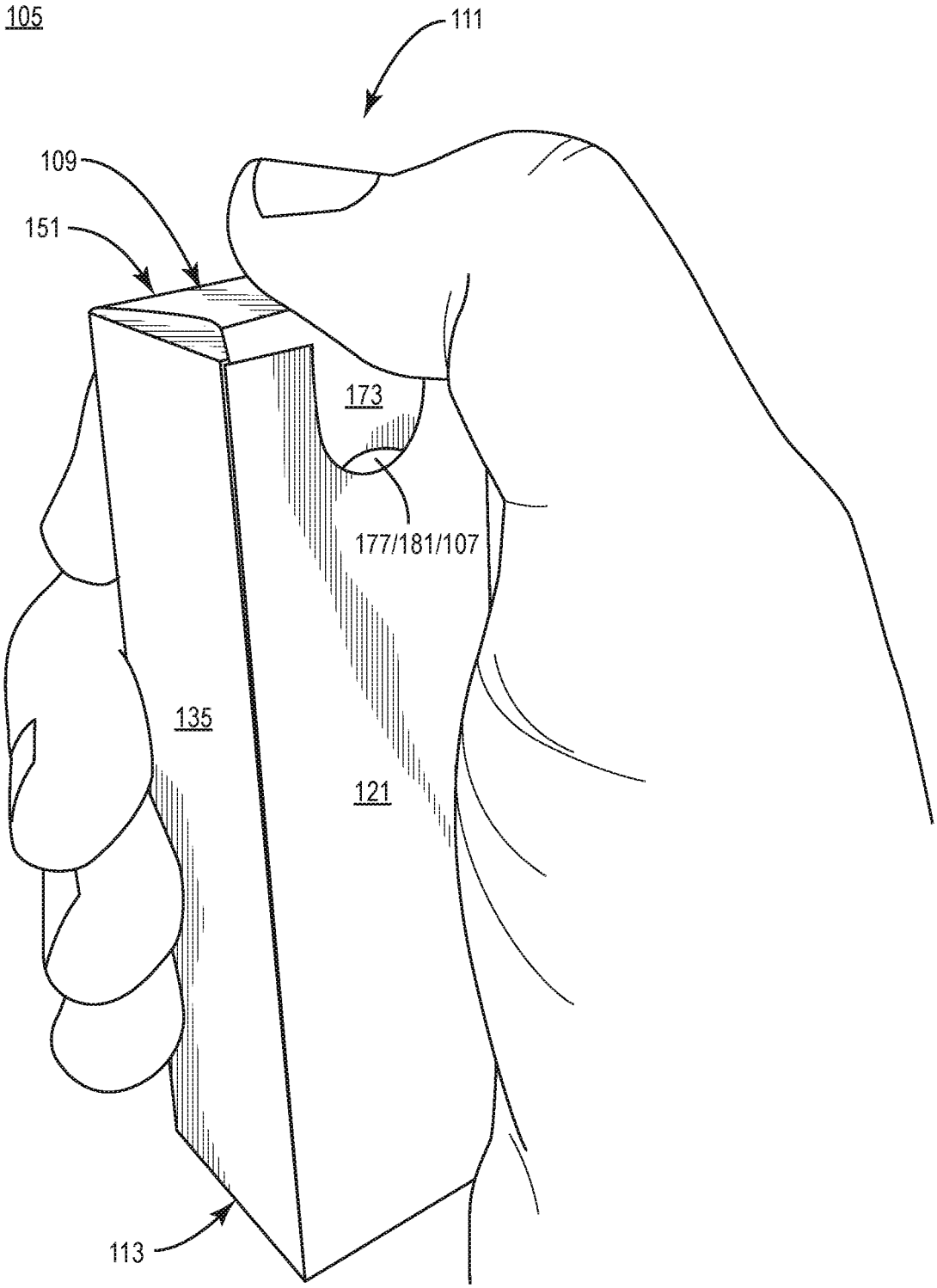
FIG. 5 is a perspective view showing a closing operation of the carton of FIG. 1 according to an exemplary embodiment of the disclosure.

With reference to FIGS. 3-5, one or more operations of the carton 105 will be described according to an exemplary embodiment of the disclosure will be described.

In order to reconfigure the dispenser 109 from a closed or first configuration to an open or second configuration, the base portion 165 of the top end flap 143 can be separated from the side panel 121 at the tear line 145 and from the distal portion 167 of the top end flap 143 at the line of weakening 169. In some embodiments, the base portion 165 of the top end flap 143 can be grasped at the access tab 166 and pulled away from the panel 121 and the distal portion 167 to effect such separation.

Upon separation of the base portion 165 of the top end flap 143 from at least the panel 121, the dispenser 109 can be free to move relative to the panels 121, 123, 127, 131, 135. In one embodiment, in order to reconfigure the dispenser 109 from the closed configuration to the open configuration, a user can contact the distal portion 173 of the top end flap 151 and/or the proximal portion 171 of the top end flap 151, e.g., proximate the fold line 175, and urge the third top end flap 151 upwardly, e.g., so as to pivotably raise above the panels 121, 123, 127, 131, 135 at the respective portion of the fold line 149.

Such movement of the top end flap 151 can include slidable movement of the distal portion 173 of the top end flap 151 against the interior surface of the side panel 121. Upon movement of the distal portion 173 of the top end flap 151 a preselected distance, the second dispenser opening 181 can be generally aligned with the first dispenser opening 177 to provide access to the interior 107 of the carton 105.

In some embodiments, the preselected distance along which the distal portion 173 of the top end flap 151 can move to provide alignment between the dispenser openings 177, 181 can correspond to a position at which the recessed notches 174 along the distal portion 173 of the top end flap 151 at least partially receive the flanged portions 148, 152 of the respective top end flaps 147, 153 so as to restrict further upward movement relative thereto. In this regard, the top end flaps 147, 153 can be positioned at least partially overlying the interior 107 of the carton 105 when the reconfigurable dispenser 109 is in each of the first configuration and the second configuration.

In this regard, the recessed notches 174 and flanged portions 148, 152 can provide stopping features that resist movement of the distal portion 173 of the top end flap 151 away from the panels 121, 123, 127, 131, 135 a maximum distance at which the dispenser openings 177, 181 can be aligned, e.g., so as to avoid inadvertent disassembly of the top end 111 of the carton 105 and to facilitate additional reconfiguration of the dispenser 109, as described further herein.

Such a second configuration of the dispenser 109 is illustrated in FIG. 3, in which the top end 111 of the carton 105 has an at least partially open configuration such that the interior 107 of the carton 105 is accessible. In such an arrangement, a desired amount of articles A can be collected upon exiting the carton 105 (e.g., subsequent to tilting and/or shaking thereof by a user) through the aligned dispenser openings 177, 181, by which individual or plural articles A can be grasped by a user and consumed, distributed, or saved for later use.

In view of the foregoing, the second dispenser opening 181 can be positioned below the first dispenser opening 177 when the dispenser 109 is in the first configuration, and the dispenser openings 177, 181 can be at least partially aligned with the dispenser 109 is in the second configuration.

When it is desired to reconfigure the dispenser 109 from the second configuration to the first configuration, e.g., when access to articles A from the interior 107 of the carton 105 is no longer needed or desired, the top end flap 151 can be pressed downwardly by a user, e.g., proximate the fold line 175 and/or on the base portion 171 and/or distal portion 173 of the top end flap 151, such that the base portion 171 of the top end flap 151 pivots downwardly at the respective portion of the fold line 149 and such that the distal portion 173 of the top end flap 151 slidably moves against the side panel 121. Such movement of the distal portion 173 of the top end flap 151 can cause the dispenser opening 181 to move downwardly out of alignment with the dispenser opening 177 and again restrict access to the interior 107 of the carton 105, e.g., so that an at least partially closed configuration of the top end 111 of the carton 105 is provided.

In some embodiments, the reconfiguration of the dispenser 109 from the open configuration to the closed configuration can be accompanied by an audible and/or tactile sensation, e.g., caused by the slidable movement of the distal portion 173 of the top end flap 151 against the side panel 121, and/or other contacting or moving edges and/or surfaces of the carton 105. Such sensation can provide sensory confirmation that the top end 111 of the carton 105 is in a closed configuration to a user, for example, so that the user may close the carton 105 and confirm the same without having to avert his or her gaze toward the carton 105.

In this regard, the carton 105 is provided with dispenser features for forming a dispenser 109 that is reconfigurable from a first configuration at least partially overlying an interior 107 of the carton 105 to provide a closed configuration of a top end 111 of the carton 105, to a second configuration, in which the dispenser 109 is lifted at least partially away from the remainder of/the interior 107 of the carton 105 to provide the at least partially aligned dispenser openings 177, 181 through which the interior 107 of the carton 105 can be accessed such that one or more articles A can be smoothly and conveniently dispensed from the carton 105.

Such an arrangement is reclosable in that the dispenser 109 can be reconfigured from the second configuration to the first configuration such that the interior 107 of the carton 105 can be selectively re-covered by the dispenser 109, e.g., so as to maintain one or more properties of remaining articles A in the interior 107 of the carton 105 (e.g., freshness, taste, flavor, texture, moisture content, etc.), to protect such articles A from environmental elements such as heat, debris, rain, pests, etc., and or to avoid spillage of such articles A during storage or transport, to name a few.

Such carton 105 is advantageously configured for grasping by a user, for example, along the corner panel 127, and the reconfigurable dispenser 109 can be conveniently opened and closed by the thumb of the user such that one handed operation is facilitated.

It will be understood that one or more portions of the blanks and cartons formed therefrom described herein can be differently shaped, configured, arranged, etc., without departing from the disclosure.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blanks. In accordance with the above-described embodiments, the blank may be constructed of paperboard of a caliper such that it is heavier and more rigid than ordinary paper. The blanks can also be constructed of other materials, such as cardboard, hard paper, or any other material having properties suitable for enabling the cartons, to function at least generally as described above. The blanks can also be laminated to or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the spaced apart slits to be replaced with a continuous slit, a continuous score, or the like. For example, a cut line can be a continuous slit or could be wider than a slit without departing from the present disclosure. Also, a tear line can be a series of cut scores passing completely, or partially, through the material, that are separated by nicks.

The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding at least one article, the carton comprising:

a plurality of panels extending at least partially around an interior of the carton, the plurality of panels comprising a front panel, a back panel, and at least one side panel, wherein the back panel at least partially defines a first dispenser opening extending from a top end of the back panel to a distal end;

a first top end flap foldably connected to the back panel of the plurality of panels along a first line of weakening having a first portion on a left side of the first dispenser opening and a second portion on a right side of the first dispenser opening, and a second top end flap foldably connected to the front panel of the plurality of panels wherein the second top end flap includes a base portion and a distal portion, the distal portion of the second top end flap at least partially defining a second dispenser opening; and a reconfigurable dispenser comprising the second top end flap, the reconfigurable dispenser being reconfigurable between a first configuration, in which the base portion extends from the back panel to the front panel providing a closed end of the carton, and a second configuration, in which the base portion is pivoted away from the back panel such that the first dispenser opening and second dispenser opening are at least partially aligned to provide access to the interior of the carton.

2. The carton of claim 1, wherein the second dispenser opening is for being positioned below the first dispenser opening when the reconfigurable dispenser is in the first configuration.

3. The carton of claim 2, wherein the distal portion of the first top end flap is foldably connected to the base portion of the first top end flap.

4. The carton of claim 3, wherein the distal portion of the first top end flap is positioned in at least partial face-to-face contact with the front panel and positioned for slidable movement relative thereto when the reconfigurable dispenser is reconfigured between the first configuration and the second configuration.

5. The carton of claim 1, wherein the carton further comprises access features for facilitating reconfiguration of the reconfigurable dispenser between the first configuration and the second configuration, the access features comprising the second top end flap in at least partial face-to-face contact with the first top end flap.

6. The carton of claim 5, wherein the at least one side panel is a first side panel, and the plurality of panels further comprises a second side panel, the second top end flap separably connected to the front panel.

7. The carton of claim 5, wherein the plurality of panels further comprises a corner panel positioned between the front panel and the at least one side panel.

8. The carton of claim 7, wherein the corner panel is foldably connected to each of the front panel and the at least one side panel at a respective curved fold line.

9. The carton of claim 7, comprising a third top end flap foldably connected to the at least one side panel, the third top end flap for at least partially overlying the interior of the carton when the reconfigurable dispenser is in each of the first configuration and the second configuration.

10. The carton of claim 9, wherein the distal portion of the first top end flap at least partially defines a recessed notch and the third top end flap at least partially defines a flanged portion, the recessed notch for at least partially receiving the flanged portion when the reconfigurable dispenser is in the second configuration.

11. The carton of claim 10, further comprising a fourth top end flap wherein the at least one side panel is a first side panel and the plurality of panels further comprises a second side panel, the fourth top end flap foldably connected to the second side panel for being positioned at least partially overlying the interior of the carton when the reconfigurable dispenser is in each of the first configuration and the second configuration, the recessed notch is a first recessed notch at least partially defined by the first top end flap and the first top end flap at least partially defines a second recessed notch, and the fourth top end flap at least partially defines a flanged portion, the second recessed notch configured for at least partially receiving the flanged portion of the fourth top end flap when the reconfigurable dispenser is in the second configuration.

12. The carton of claim 10, wherein the second top end flap comprises a base portion separably connected to the front panel a third line of weakening, and a distal portion separably connected to the base portion at a fourth line of weakening.

13. The carton of claim 1, wherein the base portion of the first top end flap is separably connected to the back panel of the plurality of panels at the first line of weakening, and a distal portion separably connected to the base portion at a second line of weakening.

14. The carton of claim 13, wherein the base portion of the second top end flap at least partially defines an access tab protruding past the distal portion of the second top end flap.

15. A blank for forming a carton for holding at least one article, the blank comprising:

a plurality of panels for extending at least partially around an interior of the carton formed from the blank, the plurality of panels comprising a front panel, a back panel, and at least one side panel, wherein the back panel at least partially defines a first dispenser opening extending from a top end of the back panel to a distal end;

a first top end flap foldably connected to the back panel of the plurality of panels along a first line of weakening having a first portion on a left side of the first dispenser opening and a second portion on a right side of the first dispenser opening, and a second top end flap foldably connected to the front panel of the plurality of panels wherein the second top end flap includes a base portion and a distal portion, the distal portion of the second top end flap at least partially defining a second dispenser opening; and features for forming a reconfigurable dispenser comprising the second top end flap, the features for forming the reconfigurable dispenser when the carton is formed from the blank such that the reconfigurable dispenser is reconfigurable between a first configuration, in which base portion extends from the back panel to the front panel providing a closed end of the carton formed from the blank, and a second configuration, in which the base portion is pivoted away from the back panel formed from the blank such that the first dispenser opening and second dispenser opening are at least partially aligned to provide access to the interior of the carton formed from the blank.

16. The blank of claim 15, wherein the distal portion of the first top end flap is foldably connected to the base portion of the first top end flap.

17. The blank of claim 16, wherein the carton further comprises access features for facilitating reconfiguration of the reconfigurable dispenser between the first configuration and the second configuration, the access features comprising the second top end flap for being positioned in at least partial face-to-face contact with the first top end flap when the carton is formed from the blank.

18. The blank of claim 17, wherein the base portion of the first top end flap is separably connected to the back panel of the plurality of panels at the first line of weakening, and a distal portion separably connected to the base portion at a second line of weakening.

19. The blank of claim 18, wherein the first dispenser opening interrupts the first line of weakening.

20. The blank of claim 18, wherein the base portion of the second top end flap at least partially defines an access tab protruding past the distal portion of the second top end flap.

21. The blank of claim 17, wherein the at least one side panel is a first side panel, and the plurality of panels further comprises a second side panel, the second top end flap separably connected to the front panel.

22. The blank of claim 17, wherein the plurality of panels further comprises a corner panel positioned between the front panel and the at least one side panel.

23. The blank of claim 22, wherein the corner panel is foldably connected to each of the front panel and the at least one side panel at a respective curved fold line.

24. The blank of claim 22, further comprising a third top end flap foldably connected to the at least one side panel, the third top end flap for at least partially overlying the interior of the carton formed from the blank when the reconfigurable dispenser is in each of the first configuration and the second configuration when the carton is formed from the blank.

25. The blank of claim 24, wherein the distal portion of the first top end flap at least partially defines a recessed notch and the third top end flap at least partially defines a flanged portion, the recessed notch for at least partially receiving the flanged portion when the reconfigurable dispenser is in the second configuration when the carton is formed from the blank.

26. The blank of claim 25, further comprising a fourth top end flap, wherein the at least one side panel is a first side panel and the plurality of panels further comprises a second side panel, the fourth top end flap foldably connected to the second side panel for being positioned at least partially overlying the interior of the carton formed from the blank when the reconfigurable dispenser is in each of the first configuration and the second configuration when the carton is formed from the blank, the recessed notch is a first recessed notch at least partially defined by the first top end flap and the first top end flap at least partially defines a second recessed notch, and the fourth top end flap at least partially defines a flanged portion, the second recessed notch for at least partially receiving the flanged portion of the fourth top end flap when the reconfigurable dispenser is in the second configuration when the carton is formed from the blank.

27. The blank of claim 25, wherein the second top end flap comprises a base portion separably connected to the front panel at a third line of weakening, and a distal portion separably connected to the base portion at a fourth line of weakening.

28. A method of forming a carton for holding at least one article, the method comprising:

obtaining a plurality of panels comprising a front panel, a back panel, and at least one side panel, wherein the back panel at least partially defines a first dispenser opening extending from a top end of the back panel to a distal end, a first top end flap foldably connected to the back panel of the plurality of panels along a first line of weakening having a first portion on a left side of the first dispenser opening and a second portion on a right side of the first dispenser opening, and a second top end flap foldably connected to the front panel of the plurality of panels wherein the second top end flap includes, a base portion and a distal portion, the distal portion of the second top end flap at least partially defining a second dispenser opening;

positioning the plurality of panels extending at least partially around an interior of the carton; and arranging the second top end flap to form a reconfigurable dispenser such that the reconfigurable dispenser is reconfigurable between a first configuration, in which the base portion extends from the back panel to the front panel providing a closed end of the carton, and a second configuration, in which the base portion is pivoted away from the back panel such that the first dispenser opening and second dispenser opening are at least partially aligned to provide access to the interior of the carton.

29. The method of claim 28, wherein arranging the second top end flap to form a reconfigurable dispenser comprises forming the reconfigurable dispenser such that the second dispenser opening is for being positioned below the first dispenser opening when the reconfigurable dispenser is in the first configuration.

30. The method of claim 29, wherein the distal portion of the first top end flap is foldably connected to the base portion of the first top end flap.

31. The method of claim 30, wherein the arranging the second top end flap to form a reconfigurable dispenser comprises forming the reconfigurable dispenser such that the distal portion of the first top end flap is positioned in at least partial face-to-face contact with the front panel and positioned for slidable movement relative thereto when the reconfigurable dispenser is reconfigured between the first configuration and the second configuration.

32. The method of claim 30, wherein the plurality of panels further comprises access features for facilitating reconfiguration of the reconfigurable dispenser between the first configuration and the second configuration, the access features comprising the second top end flap, and the method further comprises positioning the second top end flap in at least partial face-to-face contact with the first top end flap.

33. The method of claim 32, wherein the the base portion of the first top end flap is separably connected to the back panel of the plurality of panels at the first line of weakening, and a distal portion separably connected to the base portion at a second line of weakening.

34. The method of claim 33, wherein the base portion of the second top end flap at least partially defines an access tab protruding past the distal portion of the second top end flap.

35. The method of claim 32, wherein the first dispenser opening interrupts the first line of weakening.

36. The method of claim 32, wherein the at least one side panel is a first side panel, and the plurality of panels further comprises a second side panel, the second top end flap separably connected to the front panel.

37. The method of claim 32, wherein the plurality of panels further comprises a corner panel positioned between the front panel and the at least one side panel.

38. The method of claim 37, wherein the corner panel is foldably connected to each of the front panel and the at least one side panel at a respective curved fold line.

39. The method of claim 37, wherein the plurality of panels further comprises a third top end flap foldably connected to the at least one side panel, and the method further comprises positioning the third top end flap at least partially overlying the interior of the carton.

40. The method of claim 39, wherein the distal portion of the first top end flap at least partially defines a recessed notch and the third top end flap at least partially defines a flanged portion, and the method further comprises positioning the recessed notch for at least partially receiving the flanged portion when the reconfigurable dispenser is in the second configuration.

41. The method of claim 40, wherein the plurality of panels further comprises a fourth top end flap, wherein the at least one side panel is a first side panel and the plurality of panels further comprises a second side panel, the fourth top end flap foldably connected to the second side panel, the method further comprises positioning the fourth top end flap at least partially overlying the interior of the carton, the recessed notch is a first recessed notch at least partially defined by the first top end flap and the first top end flap at least partially defines a second recessed notch, and the fourth top end flap at least partially defines a flanged portion, and the arranging the second top end flap to form a reconfigurable dispenser comprises forming the reconfigurable dispenser such that the second recessed notch is positioned for at least partially receiving the flanged portion of the fourth top end flap when the reconfigurable dispenser is in the second configuration.

42. The method of claim 40, wherein the second top end flap comprises a base portion separably connected to the front panel at a third line of weakening, and a distal portion separably connected to the base portion at a fourth line of weakening.

* * * * *